United States Patent [19]

Tanaka et al.

[11] 4,411,245

[45] Oct. 25, 1983

[54] INTERNAL COMBUSTION ENGINE CONTACTLESS IGNITION SYSTEM OF SUPPLY VOLTAGE VARIATION COMPENSATION TYPE

[75] Inventors: Toshio Tanaka, Anjo; Katsuteru Miwa, Kariya, both of Japan

[73] Assignee: Nippondenso Co., Ltd., Kariya, Japan

[21] Appl. No.: 304,559

[22] Filed: Sep. 22, 1981

[30] Foreign Application Priority Data

Sep. 26, 1980 [JP] Japan ..... 55/136700

[51] Int. Cl.[3] ..... F02P 3/04

[52] U.S. Cl. ..... 123/609; 123/618; 123/626

[58] Field of Search ..... 123/418, 609, 610, 611, 123/618, 626, 644, 651

[56] References Cited

U.S. PATENT DOCUMENTS

| | | | |
|---|---|---|---|
| 3,882,840 | 5/1975 | Adamian et al. | 123/609 X |
| 4,271,812 | 6/1981 | Bodig et al. | 123/609 |
| 4,280,461 | 7/1981 | Okuda et al. | 123/644 X |
| 4,305,370 | 12/1981 | Hohne | 123/609 |

OTHER PUBLICATIONS

"Research Disclosure", May 1980, No. 196, pp. 179–180.

*Primary Examiner*—Tony M. Argenbright

*Attorney, Agent, or Firm*—Cushman, Darby & Cushman

[57] ABSTRACT

An internal combustion engine contactless ignition system of the supply voltage variation compensation type in which the length of time an ignition coil is energized is controlled by an input transistor in response to an alternating current signal synchronized with the rotation of an engine and the operating level of the input transistor is automatically shifted in response to variation of the voltage of a power source, further comprises an inverting transistor having a base connected to the collector of the input transistor, an emitter connected to one end of the power source through a common emitter resistor and a collector connected to the other end of the power source through collector resistors and a Zener diode whereby an ignition coil energization controlling power transistor is controlled through the inverting transistor.

8 Claims, 4 Drawing Figures

INTERNAL COMBUSTION ENGINE CONTACTLESS IGNITION SYSTEM OF SUPPLY VOLTAGE VARIATION COMPENSATION TYPE

The present invention relates to an improved construction for contactless or full-transistorized ignition systems used with internal combustion engines, particularly internal combustion engines for automobiles.

With known contactless ignition systems of the type in which the length of time the primary current flows through the ignition coil of an automobile internal combustion engine is varied in accordance with the engine speed, it is well known to vary the duration time of the primary current flow through the ignition coil in accordance with variation of the power supply voltage such that the duration time of the primary current flow is varied in accordance with an increase or decrease of the power supply voltage from a predetermined value.

As an example of this type of systems, a contactless ignition system is known which comprises a power transistor for controlling the duration time of the primary current flow through an ignition coil, an input transistor responsive to an ignition signal generated in synchronism with the engine rotation to control the turning on and off of the power transistor, and a Zener diode for connecting a power source to the input transistor, whereby the Zener current flowing in proportion to a rise in the power supply voltage is supplied to the input transistor and the bias condition or the operating level of the input transistor is varied. This type of known systems is disadvantageous in that since the Zener diode is directly used as a control element for varying the operating level of the input transistor, there are disadvantages from the standpoints of manufacturing process and performance in that the control tends to become unstable due to variation in characteristics among mass-produced Zener diodes and temperature changes and so on. Further, since the bias condition of the input transistor is practically linearly determined in accordance with the turning on and off, respectively, of the Zener diode, there is another disadvantage that there is the danger of the input transistor adapted to be turned on and off in response to the ignition signal being operated erroneously by noise.

It is therefore the object of the present invention to provide an internal combustion engine contactless ignition system of the supply voltage variation compensation type which overcomes the foregoing deficiencies of the prior art systems.

In accordance with a basic concept of the present invention, there is thus provided a contactless ignition system so designed that the range of variations in the operating level of the input transistor in response to variations of the power supply voltage is increased so as to provide the system with a hysteresis characteristic such that the operating level at which the input transistor is switched from the OFF state to the ON state differs substantially from that at which the input transistor is switched from the ON state to the OFF state.

Thus, in accordance with the present invention, an internal combustion engine contactless ignition system of the supply voltage variation compensation type comprising means for generating an ignition signal in synchronism with the rotation of an engine, a high voltage generating ignition coil, an input transistor and a power transistor which are responsive to the ignition signal to control the energization of the ignition coil and means responsive to the variation of a power supply voltage to vary the operating level of the input transistor, further comprises means for causing the operating level of the input transistor to exhibit a hysteresis characteristic.

Further objects, features and advantages of the present invention are described below with reference to the accompanying drawings, in which.

Figure 1:
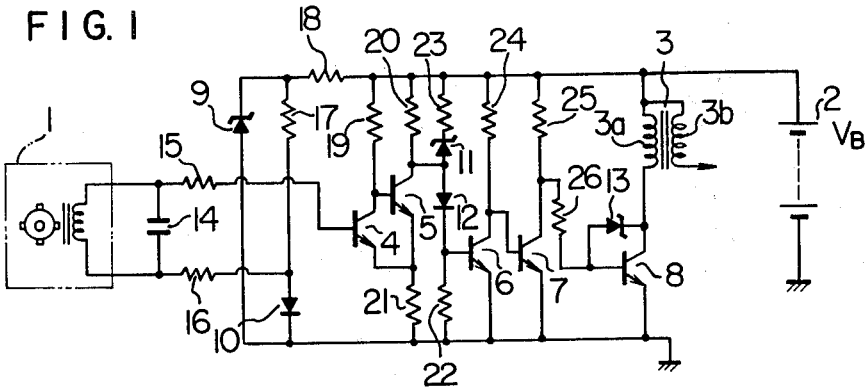
FIG. 1 is a circuit diagram showing an embodiment of an ignition system according to the present invention.
Figure 2:
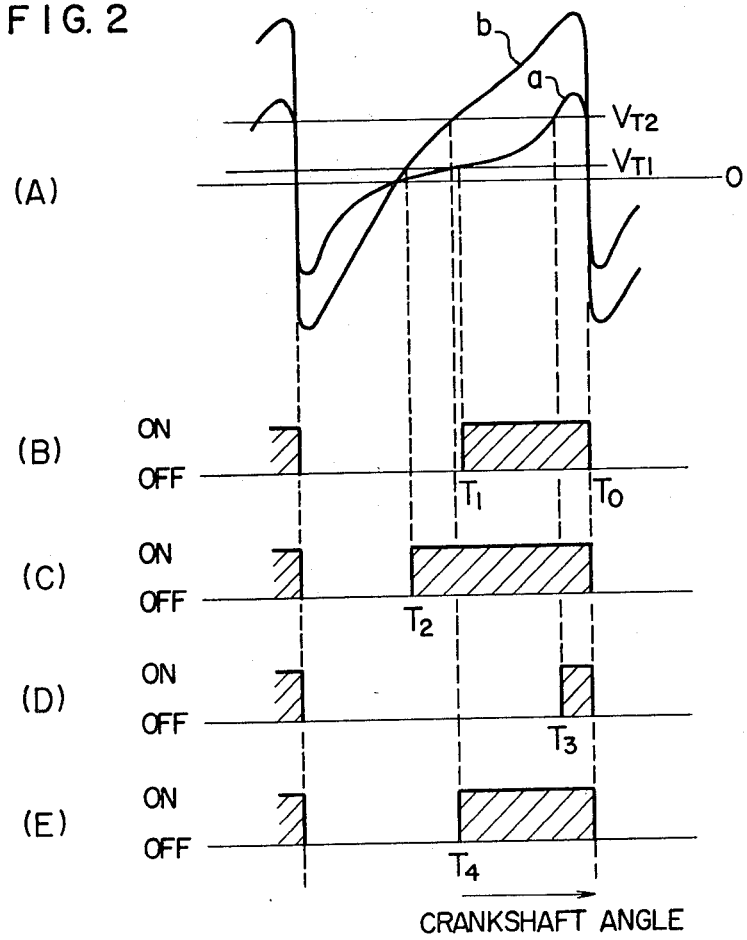
FIG. 2 shows a plurality of waveforms illustrating the operation of the input transistor and useful for explaining the operation of the system shown in FIG. 1.

Referring now to FIG. 1 illustrating an embodiment of the invention, numeral 1 designates an alternator for generating an ac voltage synchronized with the rotation of an internal combustion engine and the generated voltage generally has a waveform as shown in (A) of FIG. 2 and increases with an increase in the engine speed from the waveform a to the waveform b as shown in (A) of FIG. 2. An input transistor 4 and an inverting transistor 5 convert the generated voltage of the alternator 1 to a rectangular waveform which in turn is subjected to current amplification by transistors 6 and 7 to drive a power transistor 8. Numeral 2 designates a power source, 3 an ignition coil, 3*a* an ignition coil primary winding, 3*b* an ignition coil secondary winding, 19 a collector resistor of the input transistor 4, and 20 a collector resistor of the inverting transistor 5 with which a series circuit of a Zener diode 11 and a resistor 23 is connected in parallel. Numeral 21 designates an emitter resistor for connecting the emitters of the input transistor 4 and the inverting transistor 5 to the ground side of a power source. When the ac voltage generated by the alternator 1 is converted to a rectangular waveform by the input transistor 4 and the inverting transistor 5, the operating level of the input transistor 4 is dependent on the potential at the junction between a resistor 17 and a diode 10 and the potential at the junction between the transistors 4 and 5 and the resistor 21. The input transistor 4 and the inverting transistor 5 are alternately turned on and off so that when the power supply voltage $V_B$ is low and the Zener diode 11 is off, the operating level for turning on the transistor 4 is dependent on the base and collector currents of the transistor 5 which flow respectively through the resistors 19 and 20. On the other hand, when the power supply voltage $V_B$ exceeds the breakdown voltage of the Zener diode 11, the operating level for turning on the transistor 4 rises rapidly in dependence on the base current of the transistor 5 and its collector current that flows through the parallel connection of the resistors 20 and 23 and the operating level for turning off the transistor 4 decreases with a decrease in the current flowing through the emitter resistor 21 due to the turning off of the transistor 5. As a result, the "ON" and "OFF" operating level of the transistor 4 forming a part of a waveform reshaping circuit is provided with a hysteresis effect and this has the effect of preventing any erroneous operation due to noise. When the power supply voltage increases beyond the Zener voltage, the "ON" operating level increases considerably with the resulting increase in the hysteresis effect. The operation of the embodiment will now be described further with reference to FIG. 2 showing the relationship between the alternator ac voltage waveform and the operating waveforms of the input transistor 4 in the construction according to the present invention. In FIG. 2, (A) shows the signal waveform generated by the alternator 1, with a showing the waveform generated at low engine speed operation and b showing the waveform generated at high engine speed operation. (B) and (C) respectively show the on and off operations of the input transistor 4 corresponding to the waveforms a and b when the power supply voltage is low, and (C) and (D) respectively show the on and off operations of the input transistor 4 corresponding to the waveforms a and b when the power supply voltage is high.

The operation of the system shown in FIG. 1 will be described first with reference to a case where the power supply voltage $V_B$ is low so that the Zener diode 11 is not turned on. The waveform generated by the alternator 1 is shown in (A) of FIG. 2. If the operating level $V_T$ of the input transistor 4 is $V_{T1}$, in response to the waveform a in (A) of FIG. 2, the input transistor 4 is turned on at a point $T_1$ in (B) of FIG. 2 so that the inverting transistor 5 is turned off, the transistor 6 is turned on, the transistor 7 is turned off and the power transistor 8 is turned on. Then, the input transistor 4 is turned off at a point $T_0$ in (B) of FIG. 2 so that the power transistor 8 is turned off through the operation reverse to that mentioned previously. When the speed of the alternator 1 increases so that its output waveform increases from a to b as shown in (A) of FIG. 2, the slope of the waveform becomes more sharp and the time at which the input transistor 4 is turned on is shifted from the point $T_1$ in (B) of FIG. 2 to a point $T_2$ in (C) of FIG. 2. In this way, the turn-on point of the input transistor 4 is shifted to increase the ratio of the ON period (hereinafter referred to as a dwell angle) of the power transistor 8.

On the other hand, when the power supply voltage $V_B$ increases and exceeds the breakdown voltage of the Zener diode 11, the current flowing in the collector resistor 19 of the input transistor 4 and the base and collector currents of the inverting transistor 5 are increased. Thus, the emitter voltage of the input transistor 4 rises and its operating level is shifted from $V_{T1}$ to $V_{T2}$. As a result, at low engine speeds the turn-on point of the input transistor 4 is shifted from the point $T_1$ in (B) of FIG. 2 to a point $T_3$ in (D) of FIG. 2 with increase in the power supply voltage $V_B$. At high engine speeds the same turn-on point is shifted similarly from the point $T_2$ in (C) of FIG. 2 to a point $T_4$ in (E) of FIG. 2. In this way, the dwell angle decreases with increase in the power supply voltage $V_B$.

Figure 3:
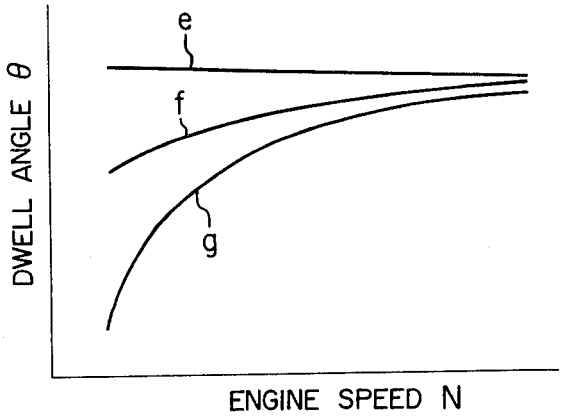
FIGS. 3 and 4 are characteristic diagrams of the system shown in FIG. 1.
Figure 4:
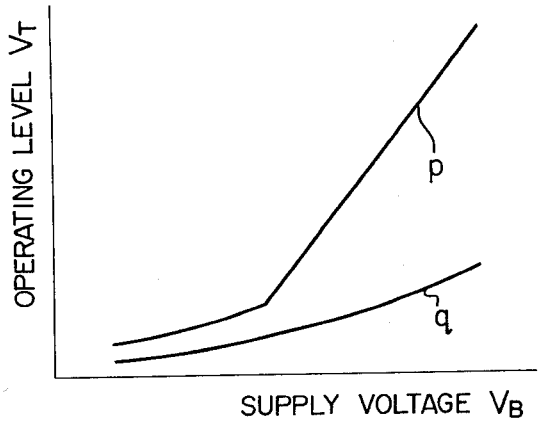

On the contrary, when the power supply voltage $V_B$ decreases, the operating level of the input transistor 4 is shifted to the lower value so that the dwell angle is increased and the energization period of the primary winding 3*a* is increased (the previously mentioned change from $T_0$–$T_1$ to $T_0$–$T_2$), thus preventing any deterioration in the sparking performance of the ignition coil 3. In FIG. 3, the abscissa represents the engine speed N and the ordinate represents the dwell angle ($\theta$) during which the primary current flows in the ignition coil 3. In the Figure, e shows an exemplary characteristic of the prior art system, and f and g respectively show a characteristic of the system of FIG. 1 when the power supply voltage is low and a characteristic of the same system when the power supply voltage is high. In accordance with the present invention, when the power supply voltage increases, the dwell angle is decreased so as to limit the current flowing in the primary winding 3*a* and thereby to improve the operating reliability of the power transistor 8. FIG. 4 is a characteristic diagram showing the relation between the variation of the power supply voltage $V_B$ and the variation of the operating level of the input transistor 4 in the system of FIG. 1. In the Figure, p shows a characteristic obtained when the power transistor 8 (the primary current of the ignition coil 3) is switched from the OFF state to the ON state and q shows a characteristic obtained when the power transistor 8 is switched from the On state to the OFF state. It will be seen from the Figure that when the power supply voltage exceeds a predetermined value, the difference between the characteristics p and q is increased and the hysteresis effect is increased.

It will thus be seen from the foregoing that in accordance with the preferred embodiment there is provided a contactless ignition system wherein the base of an inverting transistor is connected to the collector of an input transistor which is turned on and off in response to the generated output of an alternator for detecting the speed of an internal combustion engine, wherein the emitters of these transistors are connected through a common emitter resistor to the negative terminal side of a power source, wherein a base resistor is connected between the base of the inverting transistor and the positive terminal of the power source to vary the base current of the inverting transistor in response to variation of the power supply voltage, wherein a collector resistor and a series circuit of a Zener diode and a resistor are connected in parallel with each other between the collector of the inverting transistor and the positive terminal of the power source so as to vary the collector current of the inverting transistor in response to variation of the power supply voltage, and wherein a power transistor is connected to the primary winding of an ignition coil so as to be turned on and off in the same phase with the input transistor in response to the turning on and off of the inverting transistor.

In accordance with the above-described embodiment, by virtue of the operation of the Zener diode, when the power supply voltage is lower than a predetermined value, the operating level of the input transistor is reduced to a value close to zero so that the input transistor is operable even when the output voltage of the alternator is low as during the starting period of the engine. On the other hand, when the power supply voltage is higher than the predetermined value, the operating level of the input transistor is shifted to a higher value and thus the time during which the input transistor is turned on or the time during which the power transistor is turned on (the energization period of the ignition coil) is prevented from becoming excessively large.

In accordance with the above-described embodiment, by virtue of the fact that the base current of the inverting transistor is varied in dependence on the power supply voltage, not only the collector current of the inverting transistor is varied but also the current which is dependent on the power supply voltage is supplied to the collector itself of the inverting transistor, thus causing the voltage drop across the emitter resistor of the input transistor to vary greatly in response to variation of the power supply voltage. Also, by virtue of the parallel connection of the collector resistor of the inverting transistor and the Zener diode, the voltage drop across the emitter resistor is maintained at a low value close to zero when the power supply voltage is lower than a predetermined value and in response to the power supply voltage higher than the predetermined value the Zener diode is turned on to greatly increase the voltage drop, thus causing the threshold voltage for turning the input transistor on to vary greatly in response to variation of the power supply voltage. Thus, in accordance with the present invention, the length of time the primary current flows is varied so as to effectively follow up the voltage variation in either of two regions where the power supply voltage is higher and lower, respectively, than a predetermined value and moreover the length of primary current flow time can be decreased greatly in response to a variation of the power supply voltage beyond the predetermined value. Since the operating level shift of the input transistor in fact shifts only its operating level from the OFF state to the ON state, when the power supply voltage is high, due to the connection of the Zener diode to the inverting transistor, the difference between the operating level for switching the input transistor from the OFF state to the ON state and that for switching the input transistors from the ON state to the OFF state or the hysteresis is increased, thus preventing any erroneous operation due to external noise and thereby ensuring stable ignition operation.

What is claimed is:

1. An internal combustion engine contactless ignition system of the supply voltage variation compensation type including:

means for generating an alternating current signal synchronized with the rotation of an engine, an ignition coil for generating a high spark voltage, an input transistor and a power transistor which are responsive to said alternating current signal to control energization of said ignition coil, means responsive to variation of a voltage of a power source to shift an operating level of said input transistor, means for causing said operating level of said input transistor to exhibit a hysteresis characteristic, means for controlling said input transistor such that an operation level for switching said input transistor from its ON state to its OFF state substantially differs from that for switching said input transistor from its OFF state to its ON state, and further comprising an inverting transistor having a base connected to an output of said input transistor, an emitter connected to one end of said power source through a common emitter resistor and a collector connected to the other end of said power source through a collection resistor to control said power transistor.

2. A contactless ignition system according to claim 1, further comprising a Zener diode connected in parallel with said collector resistor.

3. An internal combustion engine contactless ignition system of the supply voltage variation compensation type including:

means for generating an alternating current signal synchronized with the rotation of an engine, an ignition coil for generating a high spark voltage, an input transistor and a power transistor which are responsive to said alternating current signal to control energization of said ignition coil, means responsive to variation of a voltage of a power source to shift an operating level of said input transistor, means for causing said operating level of said input transistor to exhibit a hysteresis characteristic, an alternator for generating an ac voltage in synchronism with the rotation of an engine;

a waveform reshaping circuit including an input transistor disposed to be turned on and off in response to said ac voltage from said alternator, an inverting transistor having its base connected to a collector of said input transistor and its emitter connected to an emitter of said input transistor, an emitter resistor connected between said connected emitters of said transistors and a negative terminal of a power source, a base resistor connected between the base of said inverting transistor and a positive terminal of said power source to vary a base current of said inverting transistor in response to a variation of a voltage of said power source, a collector resistor connected between a collector of said inverting transistor and the positive terminal of said power source to vary a collector current of said inverting transistor in response to a variation of said power source voltage and a series circuit of a resistor and a Zener diode connected in parallel with said collector resistor;

a power transistor responsive to turning on and off of said inverting transistor so as to be turned on and off in the same phase with said input transistor; and an ignition coil responsive to the turning on and off of said power transistor to switch on and off the flow of a primary current therethrough.

4. A contactless ignition system according to claim 3, further comprising means for controlling said input transistor such that an operation level for switching said input transistor from its ON state to its OFF state substantially differs from that for switching said input transistor from its OFF state to its ON state.

5. An internal combustion engine contactless ignition system of the supply voltage variation compensation type comprising:

means for generating an alternating current signal synchronized with the rotation of an engine, an ignition coil for generating a high spark voltage, an input transistor and a power transistor which are responsive to said alternating current signal to control energization of said ignition coil, means responsive to variation of a voltage of a power source to shift an operating level of said input transistor, means for causing said operating level of said input transistor to exhibit a hysteresis characteristic, an inverting transistor having a base connected to an output of said input transistor, an emitter connected to one end of said power source through a common emitter resistor and a collector connected to the other end of said power source through a collection resistor to control said power transistor, and a Zener diode connected in parallel with said collector resistor.

6. A contactless ignition system for an internal combustion engine comprising:

a power source having output terminals;

means for generating an AC signal synchronized with rotation of the engine;

an ignition coil for generating a high voltage;

a power transistor for making or breaking a primary current in said ignition coil;

an input transistor turning on or off in response to said AC signal;

an inverting transistor for controlling said power transistor and having a base connected to a collector of said input transistor, an emitter connected to one of said power source output terminals through an emitter resistor in common with said input transistor, and a collector connected to the other of said power source output terminals through a collector resistor; and a Zener diode connected in parallel with said collector resistor;

wherein a voltage increase of said power source exceeding a predetermined value turns ON said Zener diode, and when said inverting transistor is turned ON an electric current is caused to flow from said power source to said common emitter resistor through said inverting transistor and said parallel connection of said collector resistor and Zener diode in order to shift operational level of said input transistor in dependence upon voltage of said power source, and said input transistor exhibits a hysteresis in its turn-on and turn-off operations due to increase and decrease of electric current to said common emitter resistor accompanying turn-on and turn-off operations of said inverting transistor.

7. A contactless ignition system according to claim 1 or 6, further comprising means responsive to an operation of said input transistor to vary a bias condition of said input transistor.

8. A contactless ignition system comprising:

an alternator for generating an ac voltage in synchronism with the rotation of an engine;

a waveform reshaping circuit including an input transistor disposed to be turned on and off in response to said ac voltage from said alternator, an inverting transistor having its base connected to a collector of said input transistor and its emitter connected to an emitter of said input transistor, an emitter resistor connected between said connected emitters of said transistors and a negative terminal of a power source, a base resistor connected between the base of said inverting transistor and a positive terminal of said power source to vary a base current of said inverting transistor in response to a variation of a voltage of said power source, a collector resistor connected between a collector of said inverting transistor and the positive terminal of said power source to vary a collector current of said inverting transistor in response to a variation of said power source voltage and a series circuit of a resistor and a Zener diode connected in parallel with said collector resistor;

a power transistor responsive to turning on and off of said inverting transistor so as to be turned on and off in the same phase with said input transistor; and an ignition coil responsive to the turning on and off of said power transistor to switch on and off the flow of a primary current therethrough, wherein a voltage increase of said power source exceeding a predetermined value turns ON said Zener diode, and when said inverting transistor is turned ON an electric current is caused to flow from said power source to said common emitter resistor through said inverting transistor and said parallel connection of said collector resistor and said series circuit of said resistor and Zener diode in order to shift operational level of said input transistor in dependence upon voltage of said power source, and said input transistor exhibits a hysteresis in its turn-on and turn-off operations due to increase and decrease of electric current to said common emitter resistor accompanying turn-on and turn-off operations of said inverting transistor.

* * * * *